US009608340B2

(12) United States Patent
Weichsel et al.

(10) Patent No.: US 9,608,340 B2
(45) Date of Patent: Mar. 28, 2017

(54) METHOD FOR CONNECTING AN ELECTRICAL COMPONENT TO A COMPONENT SUPPORT, AND DEVICE

(71) Applicant: Kiekert Aktiengesellschaft, Heiligenhaus (DE)

(72) Inventors: Ulrich Weichsel, Duisburg (DE); Andreas Ziganki, Mettmann (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 0 days.

(21) Appl. No.: 14/412,820

(22) PCT Filed: Jul. 4, 2013

(86) PCT No.: PCT/DE2013/000366
§ 371 (c)(1),
(2) Date: Jan. 5, 2015

(87) PCT Pub. No.: WO2014/005573
PCT Pub. Date: Jan. 9, 2014

(65) Prior Publication Data

US 2015/0155639 A1 Jun. 4, 2015

(30) Foreign Application Priority Data

Jul. 5, 2012 (DE) ..... 10 2012 211 757

(51) Int. Cl.
*H01R 4/24* (2006.01)
*E05B 81/54* (2014.01)

(52) U.S. Cl.
CPC ..... *H01R 4/2404* (2013.01); *E05B 81/54* (2013.01); *H01R 4/2483* (2013.01)

(58) Field of Classification Search
CPC ... H01R 4/2404; H01R 4/2483; H01R 12/585
(Continued)

(56) References Cited

U.S. PATENT DOCUMENTS 3,571,779 A * 3/1971 Collier ..... H01R 9/28 361/633
3,718,750 A * 2/1973 Sayers ..... H01R 12/523 174/94 R (Continued)

FOREIGN PATENT DOCUMENTS

DE 102005049975 A1 4/2007
FR 2860349 A1 4/2005
JP 06085430 A 3/1994

OTHER PUBLICATIONS

Machine Translation of DE102005049975A1 by Lexis Nexis Total Patent on Jan. 6, 2015.

(Continued)

*Primary Examiner* — Amy Cohen Johnson
*Assistant Examiner* — Matthew T Dzierzynski
(74) *Attorney, Agent, or Firm* — Woodard, Emhardt, Moriarty, McNett & Henry LLP

(57) ABSTRACT

The invention relates to a method for connecting an electric component to an electrical component support and an electrical component for an electrical component support, in particular for a motor vehicle. According to the invention, an electric component is connected to an electrical component support which comprises a base part and an electrical conductor paths arranged therein. At least one electric contact connected to the electrical component is moved in the base part such that the electric contact is electrically connected to the conductor path. The invention also relates to two electric contacts which are connected to the electric components and which are connected, according to the claims, to two different conductor paths in the base part. Said electric components can comprise more than two electric contacts, which according to the claimed method, are connected to the conductor paths of the base part.

14 Claims, 3 Drawing Sheets

(58) Field of Classification Search
USPC ..... 439/426
See application file for complete search history.

(56) References Cited

U.S. PATENT DOCUMENTS

| | | | | |
|---|---|---|---|---|
| 4,201,436 | A * | 5/1980 | Genovese | H01R 12/616 439/426 |
| 4,953,060 | A * | 8/1990 | Lauffer | H01L 23/49827 257/713 |
| 8,390,184 | B2 * | 3/2013 | Pet | F21V 21/002 313/317 |
| 2009/0201680 | A1 | 8/2009 | Chang et al. | |

OTHER PUBLICATIONS

Machine Translation of FR2860349A1 by Lexis Nexis Total Patent on Jan. 6, 2015.
Machine Translation of JP06085430A by Lexis Nexis Total Patent on Jan. 6, 2015.

* cited by examiner

METHOD FOR CONNECTING AN ELECTRICAL COMPONENT TO A COMPONENT SUPPORT, AND DEVICE

CROSS-REFERENCE TO RELATED APPLICATIONS

This application is a National Stage of International Application No. PCT/DE2013/000366, filed Jul. 4, 2013, which is hereby incorporated by reference. PCT/DE2013/000366 claims the foreign priority benefit of German Application No. 10 2012 211 757.1 filed Jul. 5, 2012.

BACKGROUND

The invention relates to a method for connecting an electrical component to an electrical component support and to an electrical component for an electrical component support, in particular for a motor vehicle.

An electrical component support is a self-supporting structural component with a housing and electrical conductor paths placed in the housing that were basically stamped out a sheet of metal. The material of the conductor paths is so thick and therefore stable that the conductor path ends can serve as contact pins. Furthermore, the material is basically flexible so that conductor path ends can be bent in a desired direction for making contact. The conductor paths basically consist of metal such as, for example, copper, a copper alloy or steel and are in particular 0.1 mm to 1 mm thick.

Electrical components such as, for example, switches, detectors or electromotors are connected to the electrical connections of such conductor paths. Such electrical components are found, for example, in a lock, in particular a door lock of a motor vehicle.

A lock for a motor vehicle in the sense of the present invention basically comprises a rotary latch and at least one pawl with which a rotation of the rotary latch in the direction of opening can be blocked.

For manufacturing an electrical component support, for example, at first conductor paths are stamped out of a sheet of metal and prepared in a supplementary manner, if necessary by bending, for example, for the preparation, with insulating material of contact lugs and/or bores. The conductor paths prepared in this manner, that can still have connecting webs, are placed in a housing of the electrical component support. Insulating material is subsequently injection-molded in a first step for fixing the conductor paths into a casting form for forming a housing. This step is called pre-injection molding; the result is a pre-injection-molded part. Then, connecting webs—to the extent present—between the conductor paths are separated. The pre-injection-molded part is subsequently placed in another casting form and injection-molded again so that a finished housing part is formed. This finished housing part and conductor paths then form the electrical component support.

Contact lugs project out of the insulating material as a rule in order to be connected to electrical components such as, e.g., a switch. The projecting contact lugs form the electrical connections of the electrical component support.

If the electrical component support is now to be connected to an electrical component, the component that is also designated as a structural part is set at the position provided to this end and its electrical contacts are soldered to the associated electrical contact lugs. Then, a switch, for example, is inserted in such a manner that its contacts can be soldered to the projecting contacts or contact lugs of the conductor paths.

Since the conductor paths are stamped out at first in order to subsequently bend conductor path ends, among other things, upward for the preparation of contact lugs, sheeting material is required that only serves to be able to stamp out greatly bent ends from this material. The projecting part of contact lugs is not protected by insulating material against environmental influences.

An electrical component support is known from the publication DE 10 2005 049 975 A1 that comprises conductor paths stamped from tin plate that are connected to a base element. Conductor path ends are electrical contacts that are accessible from the outside. Contacts of electrical components can be connected to them.

As can be gathered from the publication DE 10 2005 049 975 A1, the requirements placed on an electrical component support during its use in a motor vehicle are very high. Such electrical component supports are exposed in the case of a motor vehicle to problematic environmental conditions, in particular as regards temperature, air moisture, dirt and mechanical jolts and vibrations.

The German patent application 10 2011 082 140.6, which is not a prior publication, teaches embedding conductor paths in an electrically insulating material. The conductor paths are completely surrounded by the electrically insulating material with the exception of electrical connections. The electrical connections are accessible from the outside so that they can be electrically connected to electrical contacts of electrical structural parts or components such as switches, detectors, electronic radio components, integrated circuit, electronic chip, electronic control device or motor, for example, by soldering. The conductor paths and electrical connections are different structural parts that are therefore independent of each other at first and can be manufactured independently of each other.

Publication DE 10 204 355 A1 teaches a control device for a motor vehicle. The electrical connections between structural elements are made available by a single-layer stamped grid. Receptacles for contact pins of structural elements are formed in the stamped grid. Structural elements are held by their contact pins in a frictional manner, that is, non-positively in the receptacles and electrically contacted.

SUMMARY

Unless otherwise indicated in the following, the previously cited features can be combined as desired individually or in any combination with the subject matter of the invention described in the following.

The invention has the problem of further developing the contacting between an electrical component and an electrical component support.

The problem of the invention is solved by a method with the features of claim 1 and by subject matter with the features of the independent claim. Advantageous embodiments result from the subclaims.

According to the claimed method an electrical component is connected to an electrical component support, wherein the electrical component support comprises a base part and electrical conductor paths present in it. At least one electrical contact connected to the electrical component is moved into the base part in such a manner that as a result the electrical contact to a conductor path is electrically connected. As a rule, this concerns two electrical contacts that are connected to the electrical component and that are connected to two different conductor paths in the base part in a manner in accordance with the claims. However, the electrical component can also comprise more than two electrical contacts that are connected according to the claimed method to conductor paths of the base part.

The method makes possible a rapid and reliable connecting of an electrical component to at least one conductor path of the electrical component support. Therefore, no soldering is necessary. Basically, electrical connections are created according to the method that are based on a positive connection and/or a non-positive connection but not on a connection wherein both have the same substance such as, for example, a solder connection. Furthermore, other advantages can be realized such as explained in the following.

The at least one electrical contact is pushed through or bored through the elastically and/or plastically deforming material of the base part in an embodiment of the invention. The elastically and/or plastically deformed material is subsequently pressed on the electrical contact. As a result, the electrical contact is advantageously held in a non-positive manner. Also, this contributes to the especially reliable screening of a conductor path present in the base part to the outside in order to protect the conductor path against disadvantageous environmental influences.

The end of the electrical contact that is moved into the base part is advantageously tapered. This facilitates boring an electrical contact into the base part or, however, pushing it through material of the base part.

In an embodiment the at least one electrical contact is constructed as pin or a screw. This embodiment also facilitates boring an electrical contact into the base part or, however, pushing it through material of the base part.

In an embodiment the at least one electrical contact is run through an opening of another electrical contact that is firmly connected to the electrical structural part. This embodiment allows the electrical contact to be subsequently pierced, bored or screwed into the base part and finally into the conductor path provided for this. Furthermore, it is advantageously not necessary to push all electrical contacts of an electrical structural part or for an electrical structural part into a base part at the same time in order to connect the electrical contacts in this manner to conductor paths in the base part.

The electrical contact that is moved into the base part comprises in an advantageous embodiment a widened head, a flange or a cross web. This embodiment makes a stop available that limits the moving of the electrical contact into the base part. This can bring it about by a suitable dimensioning that a conductor path is reliably and properly contacted in the base part. Furthermore, in this manner an electrical contact can be positively contacted in an improved manner, which contact is firmly connected to the corresponding electrical structural part.

In an advantageous embodiment an electrical contact is pushed or bored into a conductor path, preferably in such a manner that material of the conductor path is displaced and/or the electrical contact is guided through the conductor path. This secures in an improved manner the electrical contacting between the electrical contact and the conductor path. If material of a conductor path is displaced, that material of the conductor path is basically pressed onto the electrical contact. If the dl contact is guided through a conductor path the thickness of a conductor path is completely utilized for an electrical contacting.

The first independent claim and the claims dependent on it relate to an electrical component support manufactured according to a method in accordance with the claims. The electrical contacting between a conductor path and an electrical component is based in particular solely on positive and/or non-positive connections but not on a connection wherein both have the same substance.

Initially, the conductor paths of the electrical component support are advantageously completely encased by the material of the base part. The conductor paths are then inaccessible from the outside and are advantageously protected to the greatest possible extent by the material of the base part against disadvantageous environment influences. Areas of the conductor paths project in this embodiment not without protection opposite a base part or are accessible in another way from the outside and therefore exposed in particular to moisture. The conductor paths can therefore consist of a material that can resist environment influences less well but on the other hand has technical advantages. The material for the conductor paths can therefore be selected more freely in comparison to the prior art. For example, the conductor paths can consist of steel if high mechanical stability is required in order to especially well manage vibrations and jolts such as occur in the automobile area.

Furthermore, it is possible to manufacture the conductor paths from materials that can be readily manufactured technically, such as, for example, tin plate. As is already known from the prior art, tin plate is provided in one embodiment has material for the conductor paths. The tin coating of the steel in the case of tin plate ensures additional protection against corrosion.

In order to contact the conductor paths to electrical contacts of electrical structural parts, for example, contact pins are struck from the outside at a suitable position into the base part, that is, the component support, that as a consequence finally make contact with conductor paths in a desired manner. In distinction to the prior art known from DE 102 04 355 A1, contact pins of basically not inserted into already present conductor path receptacles. Instead of this, such receptacles and conductor paths are advantageously are not created until by the contacting, which lowers the requirements on manufacturing tolerances and therefore simplifies making contacts. Contact pins in the sense of the present invention are basically independent structural parts that in particular are not already connected to electrical structural parts but are first connected to electrical contacts of such structural parts, therefore, for example, by a connection wherein both have the same substance by, e.g., soldering, positive connection and/or non-positive connection.

In an embodiment of the invention the conductor paths are made available by a stamped grid. Since no material must be provided in order to make contact lugs running out of the base part possible, it is possible to save construction space and material in comparison to the prior art known from DE 10 2005 049 975 A1.

In an embodiment of the invention the housing part and/or the electrical component support comprise conduit-like recesses that run to conductor path sections provided for making contact. However, in an advantageous embodiment a layer of electrically insulating material that can protect the conductor path against environmental influences remains between the end of such a recess, which end is located in the housing part, and the conductor path. If a pin consisting of electrically conductive material is inserted into such a recess and subsequently struck or screwed further into the base part, then this pin finally reliably contacts the conductor path in the section provided for this. In an electrical component support manufactured in such a manner the material of the base part is only close to the corresponding conductor path, especially close to or pressed on a contact pin which was struck or bored in. The area of the base part comprising the recess lies, in comparison to the above, at least less tightly on the contact pin or there is no tight connection that can protect against penetrating moisture. Therefore, a slot to the contact pin can remain in the area of the recess in order to be able to set the contact pin into the recess without the expenditure of force.

The base part is constructed in particular in a self-supporting manner. It is therefore so mechanically stable that it cannot bend or at least practically not without being destroyed. The manipulation of the electrical component support is then especially simple. The electrical component support is preferably constructed in a self-supporting manner.

In an embodiment of the invention the base part consists of a self-supporting housing consisting as a rule of plastic and in particular of hard plastic into which the conductor paths are inserted. The inserted conductor paths are encased 100% by material brought by way of conclusion into the housing, for example, by injection molding. There is the possibility, depending on the contacting and the insertion of the electrical component into the electrical component support, of injecting molding the contacts and the contact pin with another elastic material. This is in particular advantageous if the contacts and/or contact pins are exposed to an increased stress such as, for example, moisture. Therefore, the base part consists in particular of one or more electrically non-conductive plastics.

In an embodiment of the invention the sections of contact paths serving for the contacting are constructed to be wider in comparison to other construction path widths. This advantageously lowers tolerances that are to be maintained for making contact. In this manner the manufacture is further simplified. These sections can have corners, thus, for example, they can have a rectangular or round form. The widened sections basically have no recesses into which contact pins should go into.

Electrical contacts connected to the conductor paths basically consist of another material than the conductor path in the base part in order to be able to do justice to the different requirements especially well. In particular, the material of the electrical contact that is connected to a conductor path in the base part is more corrosion-resistant than the material of the conductor path since the material of the contact pin can as a rule be less well protected against moisture.

In an embodiment of the invention the conductor paths in the electrical component support are arranged in such a manner relative to each other that electrical components can be arranged superposed above each other. In this case the contact pins project with different widths relative to the base part in such a manner that electrical structural parts, viewed from the conductor paths, can be advantageously arranged superposed above each other. The contact pins then as a rule enclose a right or an acute angle with conductor paths.

The accuracy requirement of the geometry of the structural parts can also be reduced by the invention. In the case of a greatly bent contact lug care must be taken for a precise positioning. If a contact pin such as, for example, a screw bores into a conductor path for making electrical contact, it is not necessary to enter exactly with the contact pin at a predefined position of the conductor paths.

In comparison to the prior art, conductor paths can be contacted with the contact lugs at any position, even in the area of conductor paths that are rising in areas.

In an embodiment of the invention the base element comprises a housing with conductor paths inserted in it and in which electrically insulating material was injection molded. In an embodiment advantageous insertion surfaces or recesses for electrical structural parts of the electrical component support are made available by the injection-molded material, e.g., for electrical contacts of a switch that stabilize the position of the switch in a positive and/or non-positive manner.

The thickness of the conductor paths is advantageously selected in such a manner that one to five, preferably up to three threads are present in the conductor path for a contact pin designed as a screw and serve for the electrical contacting. It turned out that one to three threads are satisfactory to make electrical contact in a sufficiently reliable manner even under the difficult boundary conditions of being inserted in a motor vehicle. Further increasing the number of threads leads to correspondingly thicker conductor paths. In order not to have to make the conductor paths too thick, the number of threads should be limited to a maximum of five, preferably to a maximum of three threads. 0.3 to 0.8 mm thick conductor paths are sufficient to make possible 1 to 3 threads in a practical manner.

The electrical component support is in particular part of a lock for a motor vehicle or in another manner part of a motor vehicle.

In the case of an electrical component support that was provided with contacts to electrical or electronic components in the provided manner, recesses leading to conductor paths advantageously remain partially unused, which has advantages for the manufacture. Therefore, it is possible to use the identical electrical component support for different locks, wherein only the material layers are pierced by the contact pins in which electrical components are used. In the areas in which no electrical components are used on account of the model used, the conductor path remains protected by the material layer.

Separate seals can be provided to screen electrical contacts and/or conductor paths. The seals are used underneath the contact pins between the electrical contact and the contact pin and therefore additionally prevent a penetration of moisture.

DETAILED DESCRIPTION OF THE DRAWINGS

Figure 1:
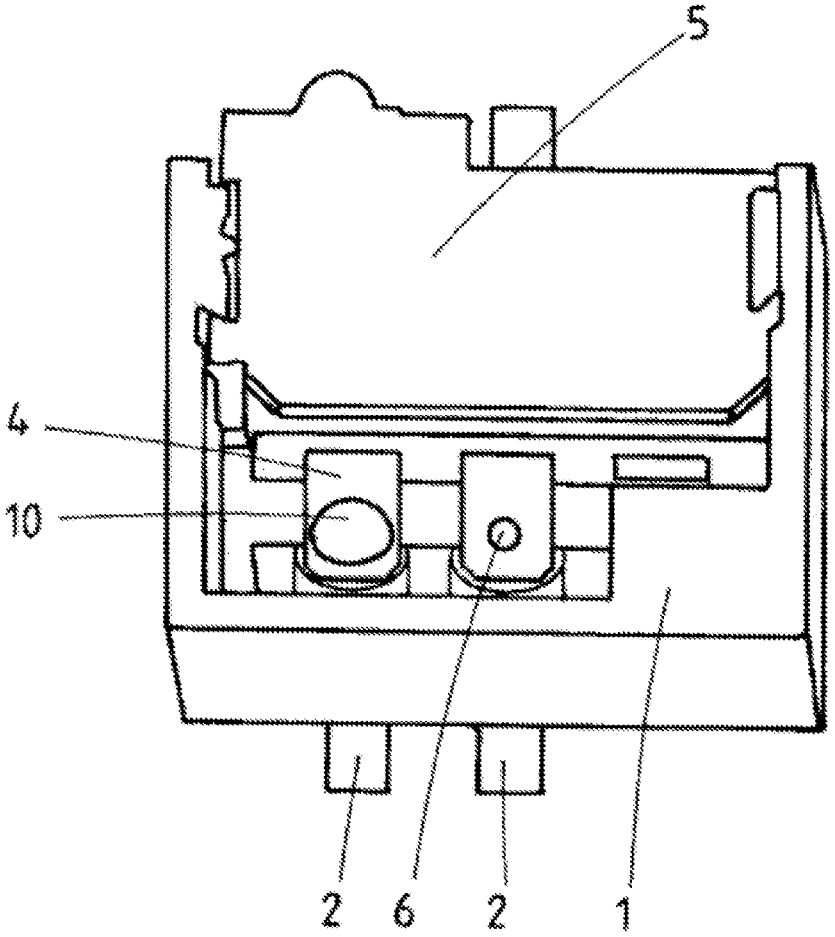
FIG. 1 shows an electrical component support with contacted microswitch.

FIG. 1 shows a sketched electrical component support. A base part or housing part 1 with two conductor paths 2 is shown in section. The conductor paths 2 are located completely in the base part 1, that is, the material, in particular an insulated plastic, completely surrounds the conductor paths 2. A completely surrounded conductor path 2 with receptacles or recesses for electrical components forms an electrical component support. The electrical component support can form a housing part of a lock at the same time. Not all areas of the base part 1 are shown in order to make the conductor paths 2 manufactured from a stamping part visible. A contact pin 3 (see FIG. 2) with a widened head 10 is inserted through a corresponding bore opening 6 of an electrical contact 4 of a microswitch 5, is subsequently inserted into a recess 7 in the base part that is shown in section in FIG. 2 and finally is struck into or screwed into a conductor path 2 through the material layer 8 of the base part 1 shown in section in FIG. 2. Then, only the material layer 8 lies closely and tightly on the contact pin 3. The electrical contact 4 of the microswitch 5 is therefore advantageously connected without soldering to the conductor path 2 located underneath it.

Furthermore, a recess is provided in the base part 1 which recess is capable of receiving and holding the microswitch 5, as is shown.

Figure 2:
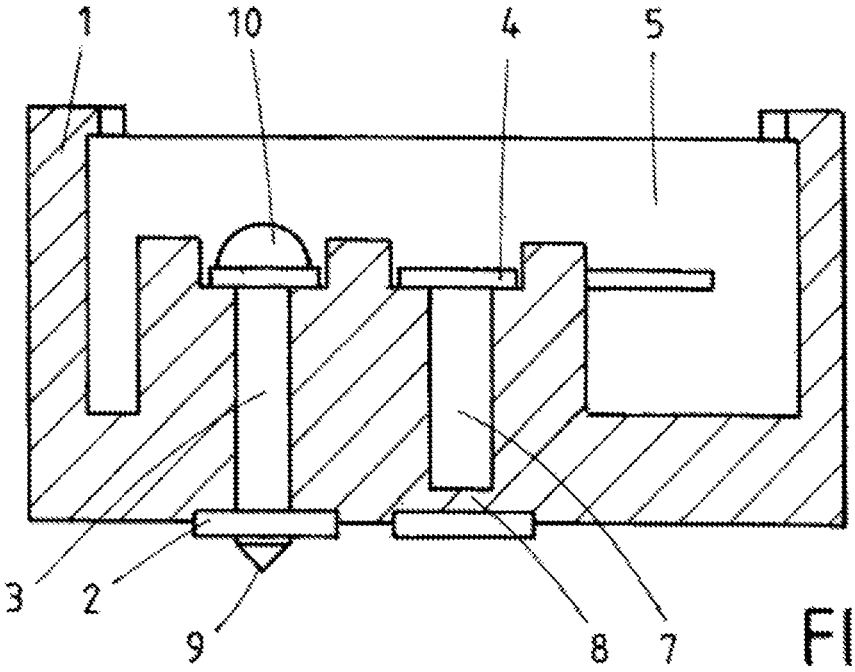
FIG. 2 shows a section through an electrical component support.

FIG. 2 illustrates that the end 9 of the contact pin 3 that was struck into the conductor path 2 tapers to a point.

Figure 3:
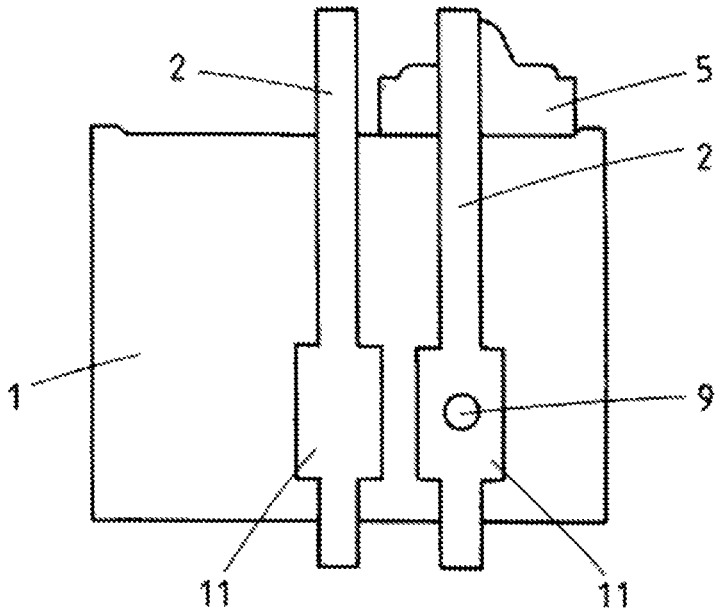
FIG. 3 shows a top view onto conductor paths of the electrical component support.

The section shown in FIG. 3 illustrates that the conductor paths 2 in the area of 11 of the contacting are widened in a rectangular manner in order to facilitate a contacting.

Unused recesses 7 in the base part that have in particular the shape of a bore advantageously remain closed toward the associated conductor path 2. Therefore, a plurality of recesses or bores 7 can be readily made available in an advantageous manner, even if only a partial amount of the bores 7 are always used for different applications. This simplifies the manufacture and therefore reduces the manufacturing expense.

Figure 4:
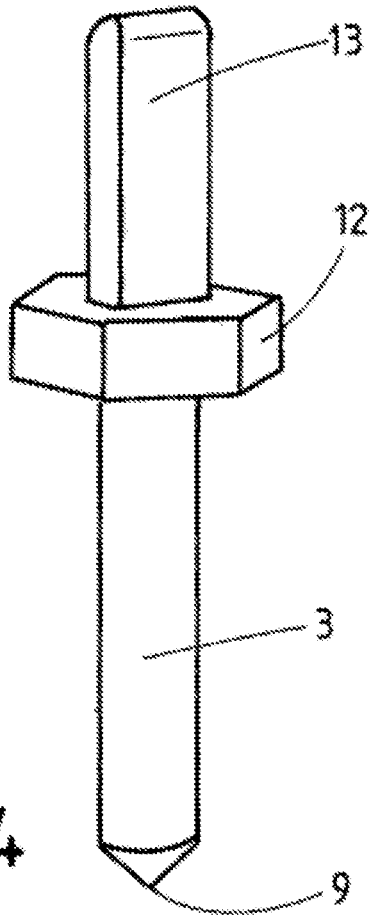
FIG. 4 shows another embodiment of a contact pin.

FIG. 4 shows another embodiment of a contact pin that is typically a contact pin of an electromotor. The area with the tapered, pointed end 9 is moved into a base part in order to finally be connected to a conductor path in the base part. This lower area is separated by a flange 12 from an upper area 13. The circumference of the flange 12 runs in a polygonal manner in an advantageous embodiment, therefore, for example, with six corners. This cornered shape can be inserted into a corresponding cornered recess of a housing of an electrical component such as, for example, of an electromotor and therefore be held by a positive locking. The upper area 13 is preferably designed flat with a rectangular cross section in order to be held in a planar and clamping manner by electrical clamping contacts inside the electrical component. The planar connection ensures a good electrical contacting and a good hold. The polygonal flanges then ensures that the section with the rectangular cross section is appropriately aligned for a mounting. This also keeps the manufacturing cost low.

The flange 12 can serve as a stop and/or seal in order to suitably limit the moving in of the lower range with the pointed end 9 into the base part. The flange 12 can be integrated in an electrical component so that the lower area with the pointed end 9 is run through a housing of the electrical component. The electrical contact pin 3 shown in FIG. 4 is then firmly connected to the electrical component or the electrical structural part.

The hexagonal flange 12 can furthermore serve for the mounting if, for example, the contact pin 3 is designed as a screw or has a threading at least in areas. It is especially readily possible to introduce a torque into the contact pin via the flange 12. The lower area with the pointed end 9 preferably has a circular or quadratic or conical cross section.

LIST OF REFERENCE NUMERALS

1. Base part
2. Conductor path
3. Contact pin
4. Electrical contact of a microswitch
5. Microswitch
6. Bore in the electrical contact of the microswitch
7. Recess in the base part and running to the conductor path
8. Material layer at the end of the base part recess
9. Pointed end of a contact pin
10. Widened head of a contact pin
11. Widened conductor path area for a contacting
12. Flange
13. Upper area of a contact pin

The invention claimed is:

1. A method comprising:

positioning an electrical component that defines a first opening and a first electrical contact in a component recess defined in a housing, wherein the housing comprises an insulating material and a first electrical conductor and the housing defines a first contact recess that extends between the component recess and the first electrical conductor, wherein the housing includes a first layer of insulating material between the first electrical conductor and the first contact recess;

aligning the first opening with the first contact recess;

inserting a first contact pin through the first opening and the first contact recess and penetrating the first layer of insulating material and the first electrical conductor thereby forming a first hole in the first electrical conductor and completing an electric circuit between the first electrical contact and the first electrical conductor.

2. The method according to claim 1, wherein the component recess is adapted to receive and hold the electrical component.

3. The method of claim 1, further comprising:

aligning a second opening defined in the electrical component with a second contact recess defined in the housing, wherein the second contact recess extends between the component recess and a second layer of insulating material positioned between a second electrical conductor and the second contact recess.

4. The method of claim 3, wherein the first and second electrical conductors are spaced apart from each other.

5. The method of claim 4, wherein the first contact recess is not aligned with the second electrical conductor.

6. The method of claim 5, wherein the second contact recess is not aligned with the first electrical conductor.

7. The method of claim 1, wherein the first contact pin has a widened head.

8. The method of claim 1, wherein the first contact pin is adapted to perform like a screw.

9. The method of claim 1, wherein the first electrical conductor includes a widened portion and a narrowed portion, wherein the widened portion is aligned with the first contact recess.

10. A system comprising:

a housing comprising an insulating material and a first electrical conductor, wherein said housing defines a component recess and a first contact recess that extends between the component recess and said first electrical conductor, wherein said housing further comprises a first layer of insulating material between said first electrical conductor and the first contact recess;

an electrical component comprising a first electrical contact, wherein said electrical component defines a first opening and wherein the component recess is adapted to receive and hold said electrical component; and a first contact pin adapted to be inserted through the first opening and the first contact recess and adapted to penetrate said first layer of insulating material and said first electrical conductor to form a hole in said first electrical conductor and to complete an electric circuit between said first electrical contact and said first electrical conductor.

11. The system of claim 10, wherein said housing further comprises a second electrical conductor, wherein said housing also defines a second contact recess that extends between the component recess and said second electrical conductor, wherein said housing further comprises a second layer of insulating material between the second contact recess and said second electrical conductor, wherein said electrical component further comprises a second electrical contact and wherein said electrical component also defines a second opening, the system further comprising a second contact pin adapted to be inserted through the second opening and second first contact recess and adapted to penetrate said second layer of insulating material and said second electrical conductor to form a hole in said second electrical conductor and to complete an electric circuit between said second electrical contact and said second electrical conductor.

12. The system of claim 10, wherein said first contact pin is adapted to perform like a screw.

13. The system of claim 10, wherein said first electrical conductor includes a widened portion and a narrowed portion, wherein said widened portion is aligned with the first contact recess.

14. The system of claim 10, wherein said first contact pin has a widened head.

* * * * *